US009683445B2

(12) United States Patent
Hoshi et al.

(10) Patent No.: US 9,683,445 B2
(45) Date of Patent: Jun. 20, 2017

(54) IMPELLER FOR CENTRIFUGAL COMPRESSOR

(75) Inventors: Toru Hoshi, Tokyo (JP); Isao Tomita, Tokyo (JP); Kenichiro Iwakiri, Tokyo (JP); Takashi Shiraishi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 765 days.

(21) Appl. No.: 13/813,351

(22) PCT Filed: Dec. 5, 2011

(86) PCT No.: PCT/JP2011/078059
§ 371 (c)(1),
(2), (4) Date: Mar. 8, 2013

(87) PCT Pub. No.: WO2012/081435
PCT Pub. Date: Jun. 21, 2012

(65) Prior Publication Data

US 2013/0195667 A1 Aug. 1, 2013

(30) Foreign Application Priority Data

Dec. 13, 2010 (JP) ..... 2010-277281

(51) Int. Cl.
*F03D 11/00* (2006.01)
*F01D 5/22* (2006.01)
(Continued)

(52) U.S. Cl.
CPC ..... *F01D 5/225* (2013.01); *F04D 29/284* (2013.01); *F04D 29/30* (2013.01)

(58) Field of Classification Search
CPC ..... F04D 29/284; F04D 29/30; F01D 5/225
See application file for complete search history.

(56) References Cited

U.S. PATENT DOCUMENTS 2,753,808 A * 7/1956 Kluge ..... F01D 5/145 416/183
3,069,072 A * 12/1962 Birmann ..... F04D 29/284 415/163

(Continued)

FOREIGN PATENT DOCUMENTS

CN 1302356 A 7/2001
CN 1842657 A 10/2006

(Continued)

OTHER PUBLICATIONS

Chinese Office Action effective Mar. 18, 2015 issued in corresponding Chinese Application No. 201180037835.9 with English Translation.

(Continued)

*Primary Examiner* — Phutthiwat Wongwian
*Assistant Examiner* — Matthew T Largi
(74) *Attorney, Agent, or Firm* — Birch, Stewart, Kolasch & Birch, LLP

(57) ABSTRACT

An impeller for a centrifugal compressor is characterized in that a shroud side of a front edge 7*a* of a splitter blade 7 is disposed so as to be displaced toward a negative-pressure surface Sb of a full blade 5F from a position equidistant from the full blades 5R and 5F in a circumferential direction such that a blade-end leakage vortex generated during a high flow rate which occurs from a blade-end clearance between the tip of the full blade 5F and a shroud toward the portion of the front edge 7*a* of the splitter blade 7 gets over the front edge 7*a* of the splitter blade 7.

5 Claims, 9 Drawing Sheets

(51) Int. Cl.
*F04D 29/28* (2006.01)
*F04D 29/30* (2006.01)

(56) References Cited

U.S. PATENT DOCUMENTS

| | | | | |
|---|---|---|---|---|
| 6,508,626 | B1 * | 1/2003 | Sakurai | F04D 29/284 416/180 |
| 8,251,649 | B2 * | 8/2012 | Goto | F04D 29/324 415/191 |
| 2004/0005220 | A1 | 1/2004 | Kawamoto et al. | |

FOREIGN PATENT DOCUMENTS

| | | | |
|---|---|---|---|
| CN | 101893003 | A | 11/2010 |
| EP | 2 392 830 | A1 | 12/2011 |
| JP | 10-213094 | A | 8/1998 |
| JP | 10213094 | A * | 8/1998 |
| JP | 2002-516960 | A1 | 6/2002 |
| JP | 2002-332992 | A | 11/2002 |
| JP | 3876195 | B2 | 1/2007 |
| JP | 2008-231933 | A | 10/2008 |
| JP | 2011-117346 | A | 6/2011 |
| WO | WO 99/61800 | A1 | 12/1999 |
| WO | WO 2011/043125 | A1 | 4/2011 |

OTHER PUBLICATIONS

Japanese Office Action dated Apr. 25, 2014 for related JP Application No. 2010-277281 with English translation.
International Preliminary Report on Patentability and Written Opinion of the International Searching Authority (Forms PCT/IB/338, PCT/IB/373, PCT/ISA/237, and PCT/IB/326) for International Apln. No. PCT/JP2011/078059, dated Jun. 27, 2013.
Decision to Grant a Patent effective Dec. 5, 2014 issued in corresponding Japanese Application No. 2010-277281 with an English Translation.
Notice of Allowance, mailed Nov. 9, 2015, issued in Chinese Patent Application No. 201180037835.9 (with English-language translation).

* cited by examiner

SHROUD-SIDE CIRCUMFERENTIAL POSITION

HUB-SIDE CIRCUMFERENTIAL POSITION

BLADE FRONT EDGE SHAPE

BLADE REAR EDGE SHAPE

SHROUD-SIDE CIRCUMFERENTIAL POSITION

HUB-SIDE CIRCUMFERENTIAL POSITION

IMPELLER FOR CENTRIFUGAL COMPRESSOR

TECHNICAL FIELD

The present invention relates to an impeller for a centrifugal compressor used in a vehicular or marine turbo charger or the like, and particularly relates to the blade shape of a splitter blade (short blade) provided between adjacent full blades.

BACKGROUND ART

In a centrifugal compressor used in a compressor portion of a vehicular or marine turbo charger or the like, kinetic energy is imparted to a fluid via the rotation of an impeller, the fluid is discharged outwardly in a radial direction, and an increase in pressure by a centrifugal force is thereby achieved. The centrifugal compressor is required to have a high pressure ratio and high efficiency in a wide operation range, and hence an impeller 05 provided with a splitter blade (short blade) 03 between adjacent full blades 01 as shown in FIGS. 23 and 24 is often used, and the blade shape of the impeller 05 is modified in various manners.

In the impeller 05 having the splitter blade 03, the full blade 01 and the splitter blade 03 are alternately disposed on the surface of a hub 07, and the common splitter blade 03 has a shape obtained by simply removing the upstream portion of the full blade 01.

In the case of the common splitter blade 03, as shown in FIG. 25, an entrance end edge (LE2) of the splitter blade 03 is positioned at a predetermined distance on the downstream side of an entrance end edge (LE1) of the full blade 01, exit end edges (TE) of both of the full blade 01 and the splitter blade 03 are provided so as to match each other, and a blade angle θ of the entrance end edge of the splitter blade 03 (shown as an angle formed between the direction of the entrance end edge and an axial direction G of the impeller 05) is set to match a direction F of flow of a fluid flowing in a flow path between the full blades 01.

However, as shown in FIG. 25, when the entrance end edge of the splitter blade 03 is designed to have a shape obtained by simply removing the upstream portion of the full blade 01 at the center between the full blades 01 in a circumferential direction, a difference represented by A1<A2 occurs between a throat area A1 on the side of a positive-pressure surface Sa of the full blade 01 and a throat area A2 on the side of a negative-pressure surface Sb thereof which are formed on both sides of the splitter blade 03, and hence there has been a problem that flow rates of individual flow paths become nonuniform, the fluid cannot be equally distributed, blade loads become unequal, loss of the flow path is increased, and an improvement in impeller efficiency is prevented. Note that the throat area denotes a cross-sectional area at a position where the distance from the entrance end edge of the splitter blade as shown in FIG. 25 to the positive-pressure surface or the negative-pressure surface of the full blade 01 is shortest.

To cope with the problem, the technology disclosed in Patent Document 1 (Japanese Patent Application Laid-open No. H10-213094) is known. In Patent Document 1, as shown in FIG. 26, the blade angle θ of the entrance end edge of a splitter blade 09 is increased to θ+Δθ (θ is increased by Δθ relative to the direction F of flow of the fluid), i.e., the entrance end edge thereof is displaced toward the negative-pressure surface Sb of the full blade 01, the throat areas in passages on both sides of the splitter blade 09 are thereby made equal to each other (A1=A2).

In addition, as the technology in which the entrance end portion of the splitter blade is inclined toward the negative-pressure surface of the full blade, Patent Document 2 (Japanese Patent Publication No. 3876195) is also known.

However, as in Patent Document 1 (FIG. 26), when the blade angle θ of the entrance end edge of the splitter blade 09 is increased to θ+Δθ, there has been apprehension that a separated flow from the front edge portion of the splitter blade 09 having the increased inclination or the negative-pressure surface Sb of the full blade 01 occurs. In addition, even when the throat areas in the passages on both of the positive-pressure surface side and the negative-pressure surface side of the splitter blade 09 are made equal to each other (A1=A2), there has been a problem that a difference in flow velocity between the passages does not allow the equalization of the flow rate.

That is, since the flow velocities on both sides of the splitter blade 09, i.e., the flow velocity on the positive-pressure surface side of the full blade 01 and that on the negative-pressure surface side thereof are different, the fluid having entered between the full blades 01 has a distribution in which a fast flow is concentrated mainly on the negative-pressure surface side so that, even when the flow path cross-sectional areas in the passages on both sides of the splitter blade 09 are made equal to each other geometrically, there has been a problem that the flow rate is increased on the negative-pressure surface side to be higher than that on the positive-pressure surface side due to the higher flow velocity on the negative-pressure surface side than that on the positive-pressure surface side, the flow rates in the individual flow paths become nonuniform, the fluid cannot be equally distributed, the blade loads become unequal, the loss of the flow path is increased, and an improvement in impeller efficiency is prevented.

Further, in the technology disclosed in Patent Document 3 (Japanese Patent Application Laid-open No. 2002-332992), as shown in FIG. 27, without changing the blade angle θ of the entrance end edge of a splitter blade 011, the front edge is displaced toward the negative-pressure surface of the full blade 01, and A1>A2 is thereby satisfied. With this arrangement, the equalization of the flow rate in passages on both sides of the splitter blade 011 is achieved.

Patent Document 1: Japanese Patent Application Laid-open No. H10-213094

Patent Document 2: Japanese Patent Publication No. 3876195

Patent Document 3: Japanese Patent Application Laid-open No. 2002-332992

However, in any of the technologies disclosed in Patent Documents 1 to 3, the improvement of the blade shape is made by focusing on the flow rate distribution of the flow paths obtained by splitting by the splitter blade on the assumption that the flow between the blades flows along the full blade. In the case of an open impeller having a blade-end clearance, an influence by a blade-end leakage flow which flows in or out of a passage from the blade-end clearance is seen, its flow field is complicated, and a further improvement to cope with the complicated internal flow has been required.

The complicated internal flow has been evaluated by numerical analysis, and it has been revealed that a leakage vortex occurring from the tip portion of the entrance end edge of the full blade (the tip portion in a direction of height of the blade from a hub surface (shroud side)) reaches close to the tip portion of the entrance end edge of the splitter blade (the tip portion in the direction of height of the blade from the hub surface (shroud side)) (see a vortex flow of a blade-end leakage flow W in FIG. 22).

The leakage vortex dose not flow along the full blade and the leakage vortex is a place where a low-energy fluid is accumulated, and hence, when the leakage vortex interferes with the entrance end edge of the splitter blade, loss generation resulting from the occurrence of separation and a vortex structure is increased.

That is, in the conventional impeller structure, a countermeasure against the interference between the leakage vortex from the tip of the entrance end edge of the full blade and the entrance end edge of the splitter blade is not taken, and hence adequate performance has not been obtained.

DISCLOSURE OF THE INVENTION

The present invention has been achieved in view of the above problems, and an object thereof is to provide an impeller for a centrifugal compressor having full blades provided adjacent to each other from an entrance portion to an exit portion of a fluid and a splitter blade provided between the full blades from some midpoint of a flow path to the exit portion in which the interference of the front edge of the splitter blade with a blade-end leakage vortex from the tip portion of the front edge of the full blade is averted and a high pressure ratio and high efficiency are thereby achieved.

In order to solve the above problem, an impeller for a centrifugal compressor of the present invention is An impeller for a centrifugal compressor having a plurality of full blades provided extending from an entrance portion to an exit portion of a fluid on a hub surface so as to stand at a regular interval in a circumferential direction and a splitter blade provided from a midpoint in a flow path, formed between the full blades provided adjacent to each other, to the exit portion, wherein a shroud side of a front edge portion of the splitter blade is disposed so as to be displaced toward a negative-pressure surface of the full blade from a position equidistant from the adjacent full blades in the circumferential direction such that a blade-end leakage vortex generated during a high flow rate, which occurs from a blade-end clearance formed between a tip of the full blade and a shroud toward the front edge portion of the splitter blade, gets over the front edge portion of the splitter blade or such that the shroud side of the front edge portion of the splitter blade matches a direction of the blade-end leakage vortex in the centrifugal compressor.

According to the above invention, by disposing the shroud side of the front edge portion of the splitter blade so as to be displaced toward the negative-pressure surface of the full blade from the position equidistant from the full blades in the circumferential direction, the interference with the blade-end leakage vortex caused by a blade-end leakage flow is reliably averted and an enhancement in the efficiency of the compressor and an improvement in characteristics thereof are thereby performed.

In the case of an open impeller in which the blade-end clearance is formed between the tip of the full blade and the shroud, the blade-end leakage vortex by the blade-end leakage flow occurs from the blade-end clearance toward the splitter blade. The blade-end leakage vortex has a strong blockage effect, and hence the fluid flowing between the full blades does not flow along the full blade in the vicinity of the tip of the splitter blade (70% of the blade span or more) and a biased flow occurs. The blade-end leakage vortex is an area where a low-energy fluid involving a strong vortex flow is accumulated. When such a flow interferes with the front edge of the splitter blade, loss generation resulting from the occurrence of separation or a vortex structure is increased.

To cope with this, in the present invention, by disposing the shroud side of the front edge portion of the splitter blade so as to be displaced toward the negative-pressure surface of the full blade from the position equidistant from the full blades in the circumferential direction, the interference with the blade-end leakage vortex is averted.

In addition, in the present invention, the position of the leakage vortex is changed according to the operation state of the compressor, and hence, based on the change tendency, the interference with the front edge portion of the splitter blade is reliably prevented in a wide operation range from a low flow rate operation to a high flow rate operation.

That is, as shown in FIG. 2, a flow path penetration force of the leakage vortex tends to be small during the high flow rate and tends to be large during the low flow rate. This is because, with an increase in flow rate, the negative pressure on the side of the negative-pressure surface of the full blade is increased to be larger than that during the low flow rate and the amount of the flow flowing in the flow path is increased so that the leakage vortex is positioned close to the negative-pressure surface of the full blade.

To cope with this, by setting the shroud side of the front edge portion of the splitter blade so as to be displaced toward the negative-pressure surface of the full blade from the position equidistant from the full blades in the circumferential direction such that the blade-end leakage vortex generated during the high flow rate operation gets over the front edge portion of the splitter blade or such that the shroud side of the front edge portion thereof matches the direction of the blade-end leakage vortex, it is possible to reliably prevent the interference with the front edge portion of the splitter blade even during the low flow rate operation, prevent the interference with the front edge portion of the splitter blade in the wide operation range, and improve the efficiency of the compressor.

Further, by setting the circumferential positions of the full blade and the splitter blade at irregular pitches, the effect of reducing a compressor noise resulting from the rotation speed and the number of blades of the centrifugal compressor is obtained.

For example, FIG. 21 is a graph having the vertical axis indicative of a noise peak value and the horizontal axis indicative of a resonance frequency. When the circumferential position of the splitter blade is moved toward the negative-pressure surface by 10%, one of splitter blade intervals is reduced from conventional 50% to 40% so that the frequency is increased by 20%. In addition, the other of the splitter blade intervals is increased from conventional 50% to 60% so that the frequency is reduced by 20%. As a result, due to phase deviation, the peak value is reduced from a to b (FIG. 21(B)).

In addition, in the present invention, a hub side of the front edge portion of the splitter blade is preferably disposed so as to be displaced toward a positive-pressure surface of the full blade from the position equidistant from the full blades in the circumferential direction.

Thus, the hub side is disposed so as to be displaced toward the positive-pressure surface of the full blade in addition to disposing the shroud side of the front edge portion of the splitter blade so as to be displaced toward the negative-pressure surface of the full blade. Although a difference in the throat width between the flow paths obtained by splitting by the splitter blade occurs and the difference therein causes nonuniformity in flow rate, by the above configuration, the nonuniformity in flow rate is corrected and the flow rate distribution is made uniform.

Consequently, a reduction in performance resulting from a difference in flow rate between the flow paths obtained by splitting caused by nonuniformity in the cross-sectional area between the flow paths is prevented.

Further, in the present invention, the shroud side of a rear edge portion of the splitter blade is preferably disposed so as to be displaced toward the negative-pressure surface of the full blade from the position equidistant from the full blades in the circumferential direction.

Thus, the shroud side of the rear edge portion is disposed so as to be displaced toward the negative-pressure surface of the full blade from the position equidistant from the full blades in the circumferential direction in addition to disposing the shroud side of the front edge portion so as to be displaced toward the negative-pressure surface of the full blade from the position equidistant from the full blades. When only the shroud side of the front edge portion is displaced, a deviation occurs in the front-rear distribution of the flow path width of the front edge portion and the rear edge portion of the flow path obtained by splitting by the splitter blade and the deviation therein causes nonuniformity in flow velocity from the front edge to the rear edge. However, according to the above configuration, the flow velocity in each of the flow paths obtained by splitting is not increased or decreased so that the flow velocities can be equalized, and a reduction in the performance of the compressor can be prevented.

Furthermore, in the present invention, the hub side of the rear edge portion of the splitter blade is preferably disposed so as to be displaced toward the positive-pressure surface of the full blade from the position equidistant from the full blades in the circumferential direction.

Thus, in addition to disposing the shroud side of the front edge portion so as to be displaced toward the negative-pressure surface of the full blade from the position equidistant from the full blades and disposing the hub side so as to be displaced toward the positive-pressure surface of the full blade from the position equidistant from the full blades, the shroud side of the rear edge portion is similarly disposed so as to be displaced toward the negative-pressure surface of the full blade from the position equidistant from the full blades in the circumferential direction, and the hub side is also disposed so as to be displaced toward the positive-pressure surface of the full blade from the position equidistant from the full blades.

With this, when only the shroud side and the hub side of the front edge portion are displaced, a deviation occurs in the front-rear distribution of the flow path width in the front edge portion and the rear edge portion of the flow path obtained by splitting by the splitter blade, and the deviation causes the nonuniformity in flow velocity from the front edge to the rear edge. However, according to the above configuration, the flow velocity in each of the flow paths obtained by splitting is not increased or decreased so that the flow velocities can be equalized, and equalization of the flow rate distribution in the flow paths obtained by splitting can be achieved by the above configuration.

Consequently, it is possible to eliminate an increase and decrease in flow velocity in each flow path obtained by splitting and prevent a reduction in the performance of the compressor by the equalization of the flow rate distribution.

Moreover, in the present invention, an inclination angle of the front edge of the splitter blade against a flow of the fluid is preferably increased to be larger than an inclination angle of the full blade corresponding to the front edge of the splitter blade and is thereby set in a direction matching a direction of the flow of the blade-end leakage vortex.

The leakage vortex is positioned close to the negative-pressure surface of the full blade during the high flow rate (see FIG. 2), and hence, by increasing an angle of attack of the front edge of the splitter blade to be larger than the inclination angle of the full blade corresponding to the front edge of the splitter blade such that the angle of attack thereof matches the inclination angle of the leakage vortex, it becomes possible to reliably and efficiently avert the interference with the blade-end leakage vortex during the low flow rate when the blade-end leakage vortex becomes strong. Note that the direction of the blade-end leakage vortex is determined through numerical analysis or a bench test.

According to the present invention, in the impeller for the centrifugal compressor having the plurality of full blades provided on the hub surface so as to stand at the regular interval in the circumferential direction from the entrance portion to the exit portion of the fluid and the splitter blade provided from some midpoint of the flow path formed between the full blades provided adjacent to each other to the exit portion, since the shroud side of the front edge portion of the splitter blade is disposed so as to be displaced toward the negative-pressure surface of the full blade from the position equidistant from the full blades in the circumferential direction such that the blade-end leakage vortex generated during the high flow rate which occurs from the blade-end clearance formed between the tip of the full blade and the shroud toward the front edge portion of the splitter blade gets over the front edge portion of the splitter blade or such that the shroud side of the front edge portion of the splitter blade matches the direction of the blade-end leakage vortex in the centrifugal compressor, it is possible to reliably avert the interference of the front edge of the splitter blade with the leakage vortex from the tip portion of the front edge of the full blade in the wide operation range to achieve a high pressure ratio and high efficiency of the centrifugal compressor.

BEST MODE FOR CARRYING OUT THE INVENTION

Figure 1:
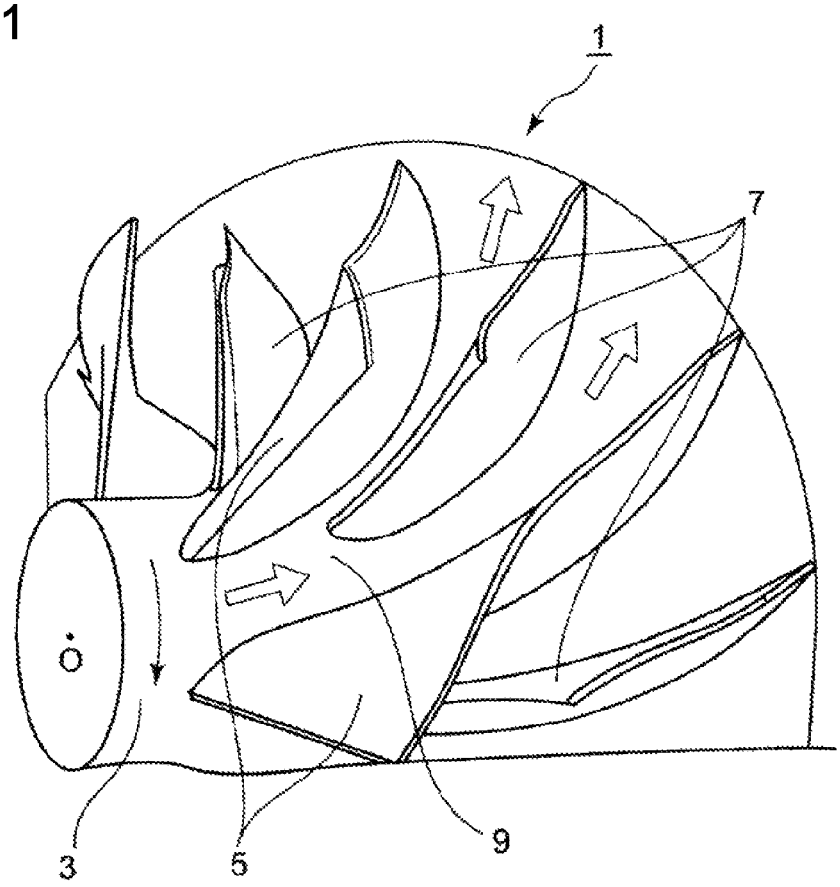
FIG. 1 is perspective view showing a principal portion of an impeller for a centrifugal compressor provided with a splitter blade of the present invention.

A detailed description is given hereinbelow of the present invention by using embodiments shown in the drawings.

Note that the scope of the present invention is not limited only to dimensions, materials, shapes, and relative arrangements of constituent parts described in the embodiments unless specifically described, and they are merely illustrative examples.

(First Embodiment)

FIG. 1 is a perspective view showing a principal portion of an impeller for a centrifugal compressor to which a splitter blade of the present invention is applied. In an impeller 1, a plurality of adjacent full blades 5 and splitter blades 7 disposed between the full blades 5 are alternately provided at regular pitches in a circumferential direction so as to stand on an upper surface of a hub 3 fitted to a rotor shaft (not shown). The splitter blade 7 is shorter in length than the full blade 5 in a direction of flow of a fluid, and is provided from some midpoint of a flow path 9 formed between the front and rear full blades 5 to an exit portion. The impeller 1 rotates in a direction indicated by an arrow, and the center thereof is indicated by O.

Figure 2:
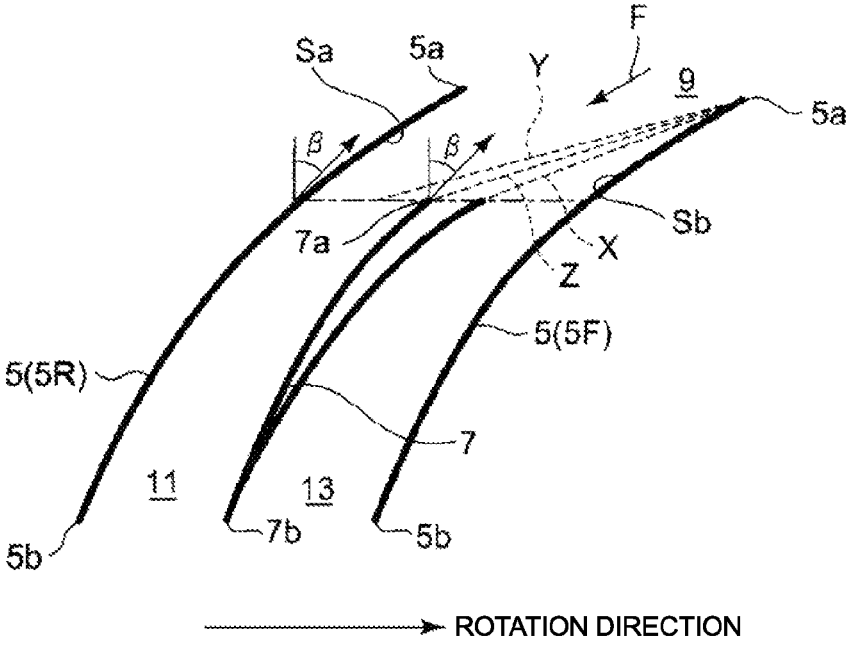
FIG. 2 is an explanatory view showing the relationship between a full blade and a splitter blade of a first embodiment and the direction of a blade-end leakage vortex.

FIG. 2 shows the relationship between the splitter blade 7 and the full blade 5 in terms of the arrangement relationship in a shroud-side position, i.e., a blade tip-side position.

A front edge 7*a* as the leading edge of the splitter blade 7 is positioned on the downstream side of a front edge 5*a* as the leading edge of the full blade 5 in the flow direction, and the position of a rear edge 7*b* as the trailing edge of the splitter blade 7 and the position of a rear edge 5*b* as the trailing edge of the full blade 5 are provided so as to match each other in the circumferential direction.

In addition, the splitter blade 7 is positioned such that the flow path 9 formed between the side of a positive-pressure surface Sa of the full blade 5 and the side of a negative-pressure surface Sb of the full blade 5 is halved by the splitter blade 7 in the circumferential direction, a flow path 11 is formed between the splitter blade 7 and the wall surface on the side of the positive-pressure surface Sa of the full blade 5, and a flow path 13 is formed between the splitter blade 7 and the wall surface on the side of the negative-pressure surface Sb of the full blade 5.

Further, the shape of the splitter blade 7 is formed so as to run parallel with the full blade 5, and an inclination angle β of the front edge 7*a* of the splitter blade 7 is the same as the inclination angle of the full blade 5.

The impeller 1 thus configured is formed as an open impeller having a blade-end clearance between the full blade 5 and a shroud (not shown) covering the splitter blade 7.

Consequently, a blade-end leakage flow W in which a fluid on the positive-pressure surface side of the full blade 5 in an adjacent fluid passage (on the front side in a rotation direction) leaks to the negative-pressure surface side of the full blade 5 through the clearance portion between the tip portion of the front edge of the full blade 5 (shroud side) and the shroud occurs.

Figure 22:
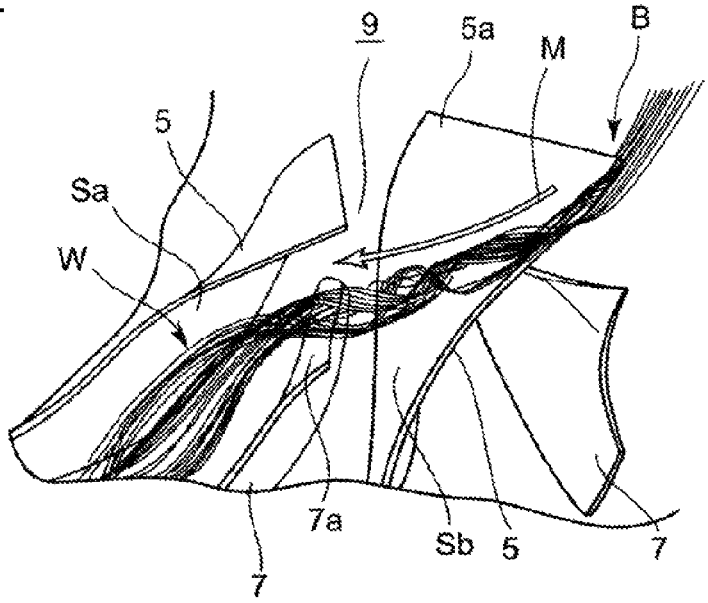
FIG. 22 is the result of numerical analysis showing a blade-end leakage flow from a tip portion of the full blade formed at a tip portion of an entrance end portion of the splitter blade.
Figure 23:
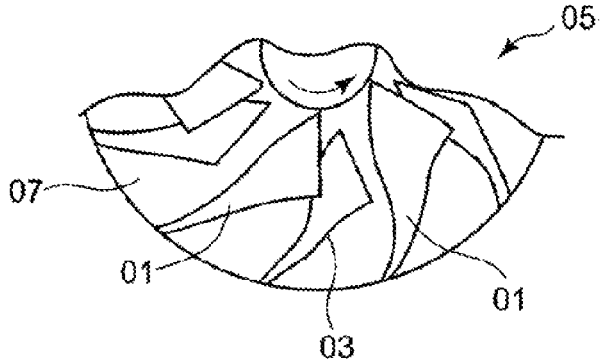
FIG. 23 is an explanatory view of a conventional art.
Figure 24:
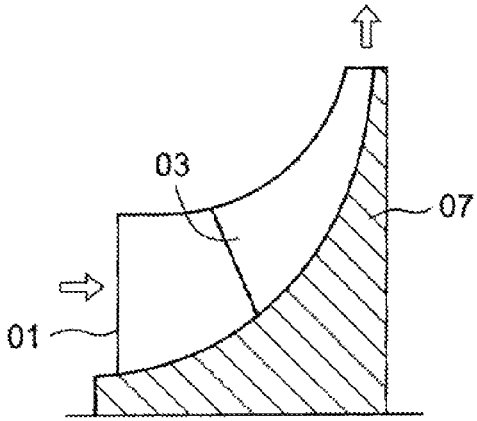
FIG. 24 is an explanatory view of the conventional art.
Figure 25:
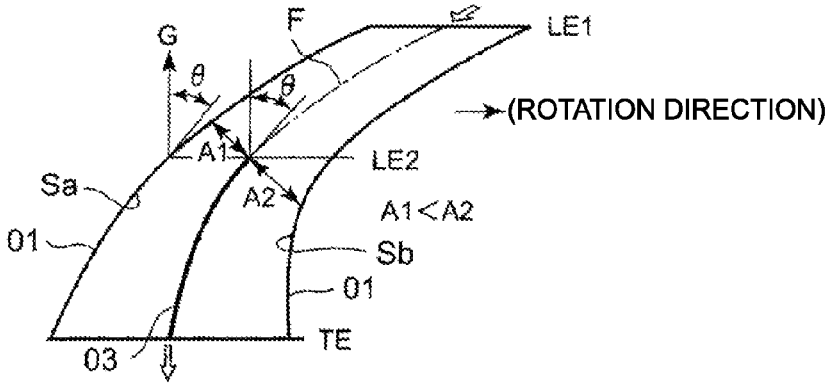
FIG. 25 is an explanatory view of the conventional art.
Figure 26:
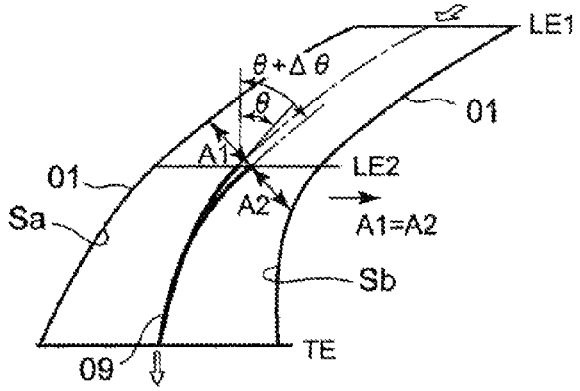
FIG. 26 is an explanatory view of the conventional art.
Figure 27:
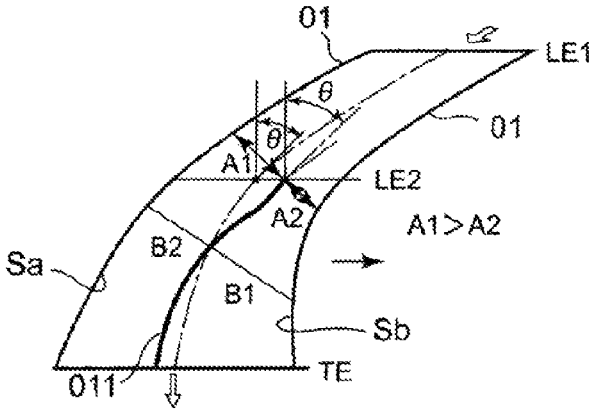
FIG. 27 is an explanatory view of the conventional art.

The blade-end leakage flow W influences the flow in the vicinity of the front edge 7*a* of the splitter blade 7, and hence numerical analysis has been performed on the state of the blade-end leakage flow W. A view of flow lines as the result of the numerical analysis is shown in FIG. 22.

The blade-end leakage flow occurs through a clearance portion B between the tip portion of the leading edge portion 5*a* of the full blade 5 and the shroud. As shown in FIG. 22, the blade-end leakage flow W involves a strong vortex (blade-end leakage vortex) and has a strong blockage effect on the flow along the full blade 5 so that the flow in the vicinity of the front edge 7*a* of the splitter blade 7 does not flow along the full blade 5, and a biased flow M moving toward the front edge of the splitter blade 7 having the vortex as a nucleus occurs.

As shown in FIG. 2, when the flow rate is high, the flow rate of the blade-end leakage is increased, the negative pressure is increased, and the direction of the blade-end leakage flow W tends to be biased toward the negative-pressure surface Sb of the full blade 5 to correspond to a line X direction, while when the flow rate is low, the flow rate of the blade-end leakage is reduced, the negative pressure is reduced, and the direction of the blade-end leakage flow W tends to be biased away from the negative-pressure surface Sb of the full blade 5 to correspond to a line Y direction.

During the high flow rate, a flow path penetration force of the leakage vortex tends to be small, while during the low flow rate, the flow path penetration force thereof tends to be large. With an increase in flow rate, the negative pressure on the negative-pressure surface side of the full blade becomes larger than that during the low flow rate and the amount of the flow flowing in the flow path is increased so that the leakage vortex is expected to be positioned close to the negative-pressure surface of the full blade. Note that "during the high flow rate" denotes during an operation in a range of the flow rate exceeding the flow rate at peak efficiency.

Consequently, the shroud side of the front edge 7*a* of the splitter blade 7 is disposed so as to be displaced toward the negative-pressure surface Sb of the full blade 5 from the position equidistant from the full blades 5 in the circumferential direction such that the blade-end leakage vortex generated during the high flow rate gets over the shroud side of the front edge 7*a* of the splitter blade 7 or such that the blade-end leakage vortex substantially opposes (matches) the shroud side thereof.

"Substantially opposes (matches)" denotes a state in which the inclination angle β of the shroud side of the front edge 7*a* of the splitter blade 7 substantially matches the direction of flow of the blade-end leakage vortex and the vortex flow and the shroud side of the front edge 7 of the splitter blade 7 do not interfere with each other.

The splitter blade 7 is positioned in the middle portion between a front full blade 5F and a rear full blade 5R, and the position of the front edge 7*a* is also set at the middle portion between the front full blade 5F and the rear full blade 5R. Various methods are used to set the position of the front edge 7*a* of the splitter blade 7 in a length direction.

For example, as shown in FIG. 2, there is a method in which a line Z indicative of the direction of the blade-end leakage vortex at an efficiency peak point, i.e., the direction of the leakage flow is calculated by numerical analysis or a test using actual equipment, and the position of the front edge 7*a* of the splitter blade 7 in the length direction is set as a point of intersection of the line Z and a middle point between the front full blade 5F and the rear full blade 5R.

Alternatively, there is a method in which a line joining a central position of what is called a throat which forms the shortest distance from the front edge 5*a* of the rear full blade 5R to the negative-pressure surface Sb of the front full blade 5F provided adjacent to the rear full blade 5R on the front side in the rotation direction and the front edge 5*a* of the front full blade 5F is set as the line Z as the direction of the blade-end leakage vortex, and the position of the front edge 7*a* of the splitter full blade 7 in the length direction is set as a point of intersection of the line Z and the middle point between the front full blade 5F and the rear full blade 5R.

In any method, the line Z serving as the reference indicative of the direction of the blade-end leakage vortex is determined, and the position of the front edge 7*a* of the splitter blade 7 in the length direction is set as the point of intersection of the line Z and the middle point between the front full blade 5F and the rear full blade 5R.

In the front edge 7*a* of the splitter blade 7 set in the above manner and serving as the reference, the position of the shroud side is inclined so as to be positioned on the front full blade 5F side of the line X direction indicative of the direction of the blade-end leakage vortex during the high flow rate as shown in FIG. 2, or substantially oppose the line X direction.

Figure 3:
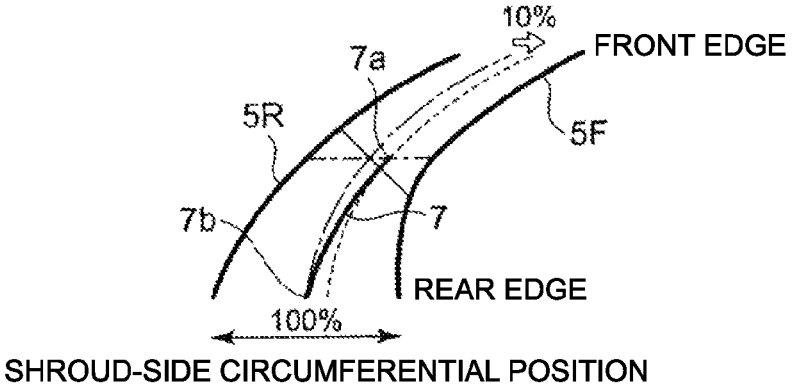
FIG. 3 is an explanatory view showing the relationship between the full blade and the splitter blade of the first embodiment and showing the relationship of a shroud-side circumferential position.
Figure 4:
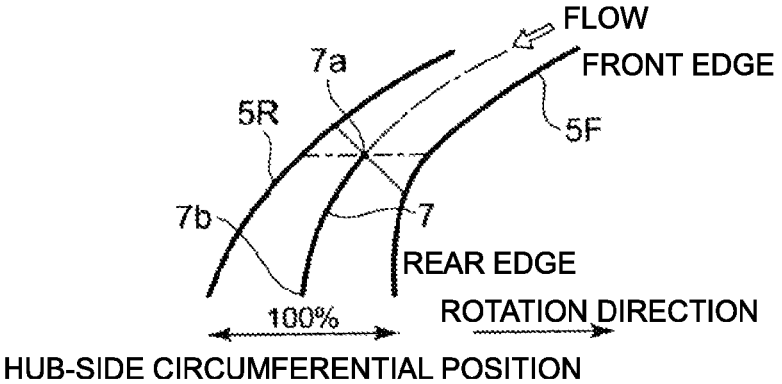
FIG. 4 is an explanatory view showing the relationship between the full blade and the splitter blade of the first embodiment and showing the relationship of a hub-side circumferential position.

Each of FIGS. 3 to 6 shows a specific example in which the position of the shroud side of the front edge 7*a* of the splitter blade 7 is displaced toward the negative-pressure surface Sb of the full blade 5. For example, a displacement amount is assumed to be 10%. Note that FIG. 3 shows the shroud-side circumferential positional relationship between the full blade 5 and the splitter blade 7. FIG. 4 shows the hub-side circumferential positional relationship therebetween. Thus, without displacing the portion of the rear edge 7*b*, only the shroud side of the front edge 7*a* is inclined so as to be displaced toward the negative-pressure surface Sb of the front full blade 5F.

Figure 5:
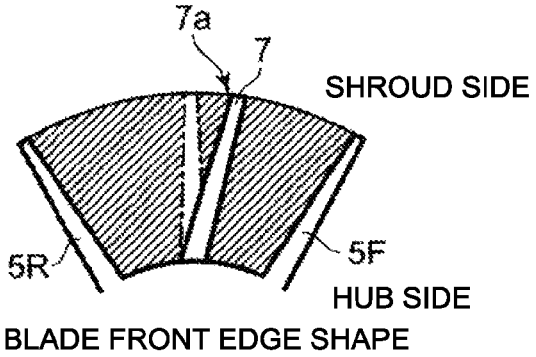
FIG. 5 is a front view showing a front edge shape of the splitter blade of the first embodiment.
Figure 6:
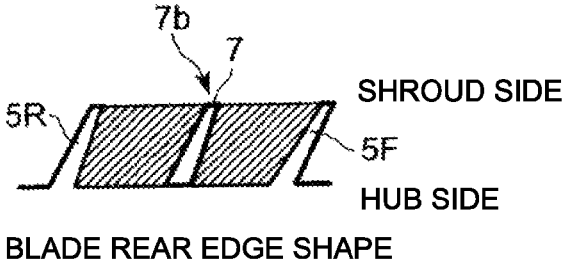
FIG. 6 is a front view showing a rear edge shape of the splitter blade of the first embodiment.

FIG. 5 is a front view showing the front edge shape of the splitter blade 7, while FIG. 6 is a front view showing the rear edge shape of the splitter blade 7. The rear edge 7*b* is not changed but only the shroud side of the front edge 7*a* is inclined toward the negative-pressure surface Sb of the front full blade 5F.

According to the above first embodiment, by setting such that the blade-end leakage vortex generated on the side of the high flow rate where the blade-end leakage vortex is weak (the blade-end leakage vortex strongly tends to be biased toward the negative-pressure surface Sb of the front full blade 5F and the penetration force required to penetrate through the flow path 9 is small) gets over the front edge portion of the splitter blade, it is possible to reliably prevent the interference of the blade-end leakage vortex onside of the low flow rate where the blade-end leakage vortex is strong.

That is, as shown in FIG. 2, by setting the angle of attack of the front edge 7*a* of the splitter blade 7 through the test using the actual equipment on the side of the high flow rate, it becomes possible to reliably prevent the interference of the blade-end leakage vortex in a wide operation range.

In addition, by setting the circumferential positions of the full blade 5 and the splitter blade 7 at irregular pitches, the effect of reducing a compressor noise resulting from the rotation speed and the number of blades of the centrifugal compressor is obtained.

Figure 21:
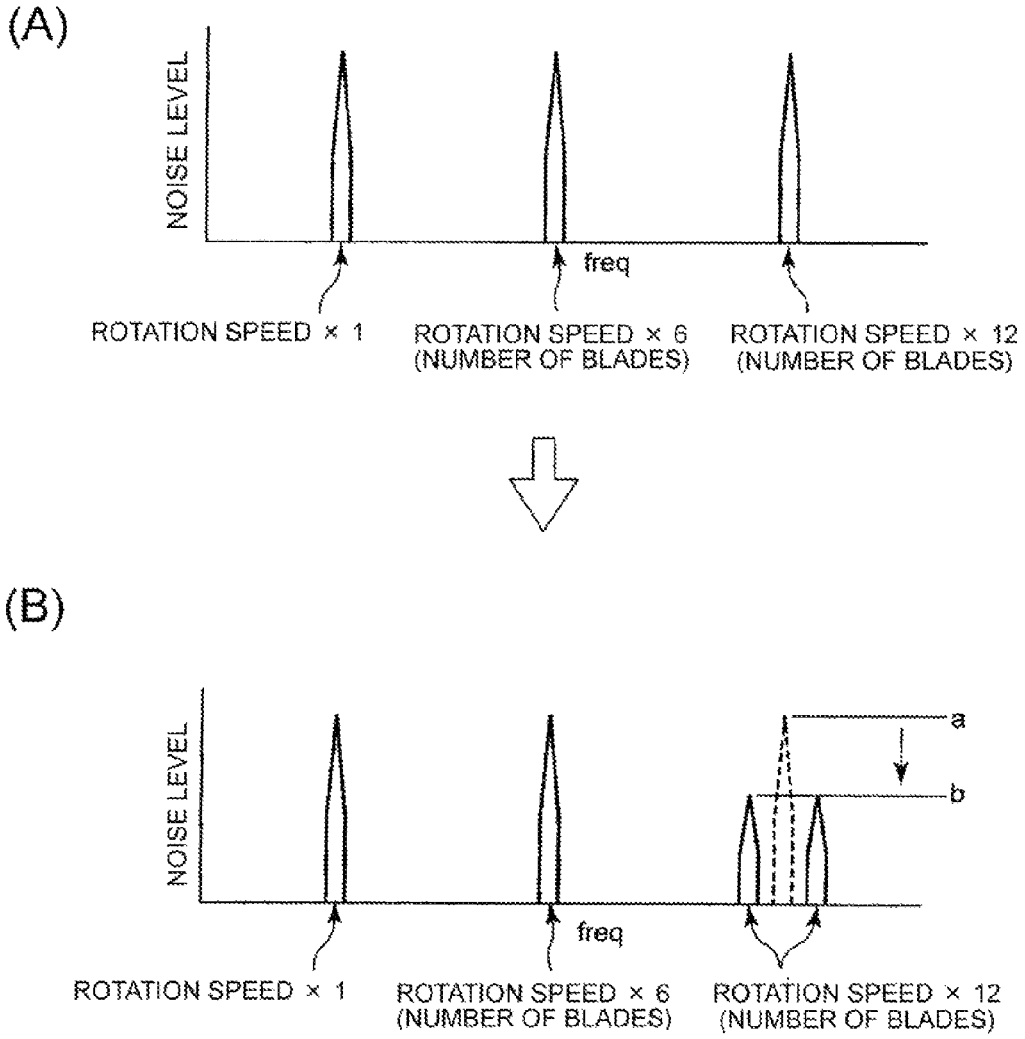
FIG. 21 is an explanatory view showing the relationship of a compressor noise resulting from the number of blades.

For example, as shown in FIG. 21, when the circumferential position of the splitter blade is moved toward the negative-pressure surface by 10%, one of splitter blade intervals is reduced from conventional 50% to 40% so that a frequency is increased by 20%. In addition, the other of the splitter blade intervals is increased from conventional 50% to 60% so that the frequency is reduced by 20%. As a result, due to phase deviation, a peak value is reduced from a to b (FIG. 21(B)).

(Second Embodiment)

Next, a second embodiment is described with reference to FIGS. 7 to 10.

The second embodiment is characterized in that, in addition to the first embodiment, the hub side of the front edge 7*a* of the splitter blade 7 is disposed so as to be displaced toward the positive-pressure surface Sa of the rear full blade 5R from the position equidistant from the front and rear full blades 5F and 5R in the circumferential direction.

Figure 7:
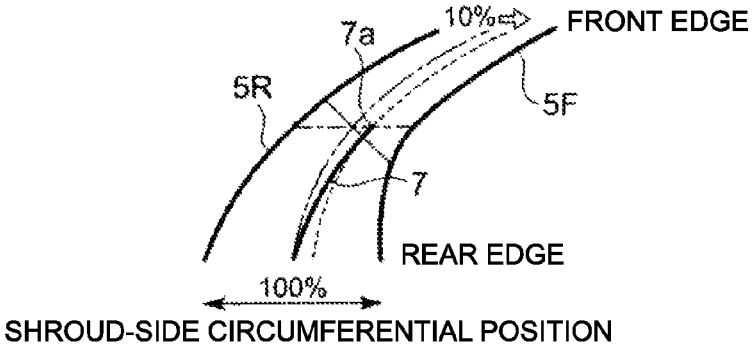
FIG. 7 is an explanatory view showing the relationship between a full blade and a splitter blade of a second embodiment and showing the relationship of a shroud-side circumferential position.
Figure 8:
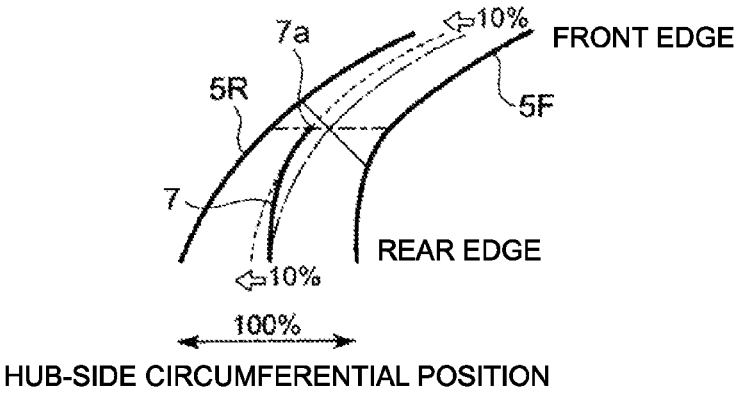
FIG. 8 is an explanatory view showing the relationship between the full blade and the splitter blade of the second embodiment and showing the relationship of a hub-side circumferential position.

As shown in FIG. 7, the shroud side of the front edge 7*a* of the splitter blade 7 is positioned so as to be displaced toward the negative-pressure surface Sb of the front full blade 5F and, as shown in FIG. 8, the hub side of the front edge 7*a* is also displaced toward the positive-pressure surface Sa of the rear full blade 5R. The displacement amount toward the positive-pressure surface Sa and the displacement amount toward the negative-pressure surface Sb are equally set to 10%. described above, the displacement amount is preset as the displacement amount during the high flow rate through the numerical calculation or the test.

Figure 9:
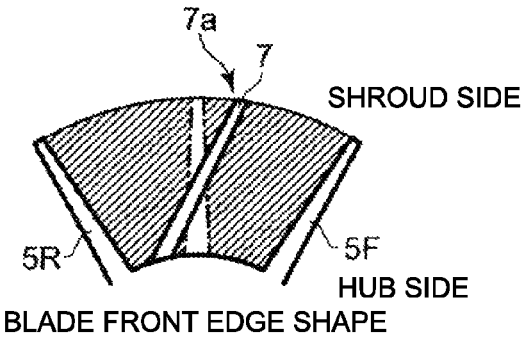
FIG. 9 is a front view showing a front edge shape of the splitter blade of the second embodiment.
Figure 10:
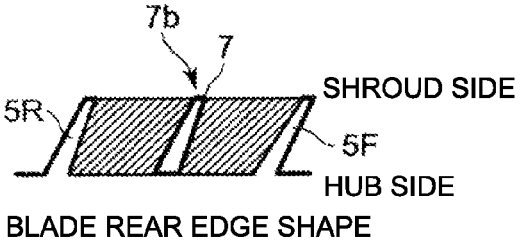
FIG. 10 is a front view showing a rear edge shape of the splitter blade of the second embodiment.

As in FIGS. 7, 8, and 9, on the side of the rear edge 7*b*, the shroud side or the hub side thereof is not displaced but is disposed at the middle portion between the front and rear full blades 5F and 5R. As indicated by the front edge shape of FIG. 9, in the portion of the front edge 7*a* of the splitter blade 7, the shroud side and the hub side are displaced in mutually opposite directions by the same amount, and hence nonuniformity in the throat width between the flow paths 11 and 13 obtained by splitting by the splitter blade 7 is corrected and the flow rate distribution in the portion of the front edge 7*a* is made uniform.

Consequently, a reduction in performance resulting from a difference in flow rate between the flow paths obtained by the splitting caused by nonuniformity in the cross-sectional area of the entrance portion between the flow paths 11 and 13 is prevented.

(Third Embodiment)

Next, a third embodiment is described with reference to FIGS. 11 to 14.

The third embodiment is characterized in that, in addition to the second embodiment, the shroud side of the rear edge 7*b* of the splitter blade 7 is disposed so as to be displaced toward the negative-pressure surface Sb of the front full blade 5F from the position equidistant from the front and rear full blades 5F and 5R in the circumferential direction.

Figure 11:
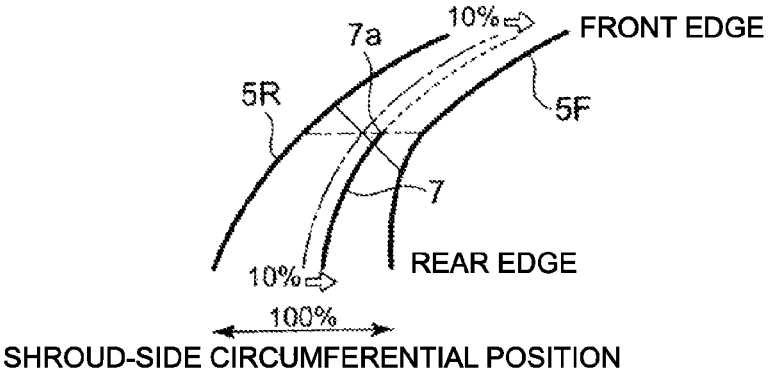
FIG. 11 is an explanatory view showing the relationship between a full blade and a splitter blade of a third embodiment and showing the relationship of a shroud-side circumferential position.
Figure 12:
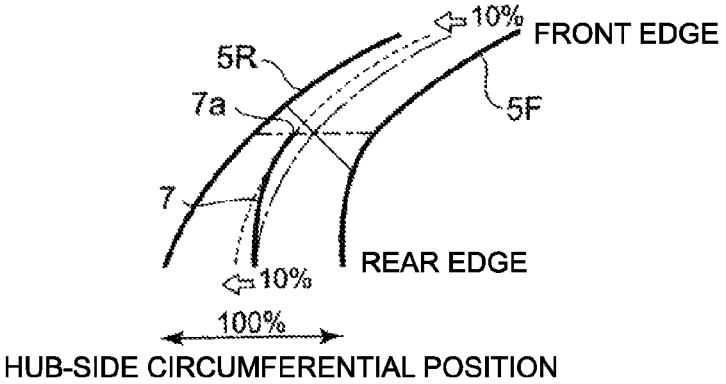
FIG. 12 is an explanatory view showing the relationship between the full blade and the splitter blade of the third embodiment and showing the relationship of a hub-side circumferential position.
Figure 13:
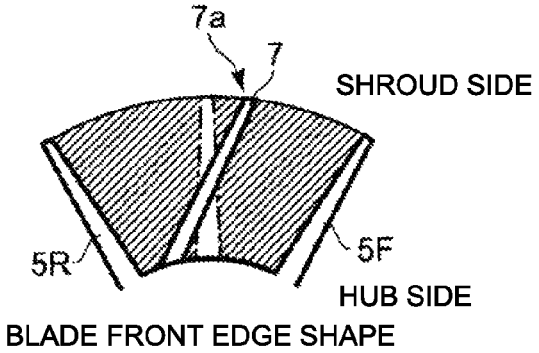
FIG. 13 is a front view showing a front edge shape of the splitter blade of the third embodiment.

As shown in FIG. 11, the shroud side of the rear edge 7*b* of the splitter blade 7 is positioned so as to be displaced toward the negative-pressure surface Sb of the front full blade 5F and, as shown in FIG. 12, on the hub side, only the front edge 7*a* is displaced toward the positive-pressure surface Sa of the rear full blade 5R similarly to the second embodiment and the shroud side is disposed at the position equidistant from the front and rear full blades 5F and 5R in the circumferential direction. The displacement amount toward the positive-pressure surface Sa and the displacement amount toward the negative-pressure surface Sb are equally set to 10% similarly to the second embodiment.

Figure 14:
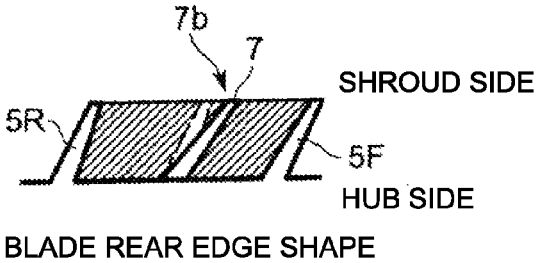
FIG. 14 is a front view showing a rear edge shape of the splitter blade of the third embodiment.

As in FIGS. 11, 12, and 14, on the side of the rear edge 7*b*, only the shroud side is displaced toward the negative-pressure surface Sb of the front full blade 5F.

With the above configuration, the shroud side and the hub side are displaced in mutually opposite directions in the portion of the front edge 7*a* of the splitter blade 7, and hence the nonuniformity in throat width between the flow paths 11 and 13 obtained by splitting by the splitter blade 7 is corrected, and the flow rate distribution in the portion of the front edge is made uniform.

Further, a deviation is less likely to occur in the front-rear distribution of the front edge portion and the rear edge portion of each of the flow paths 11 and 13 obtained by splitting by the splitter blade 7, nonuniformity in flow velocity from the front edge to the rear edge is less likely to occur, the flow velocity in each of the flow paths 11 and 13 obtained by splitting is not increased or decreased so that the flow velocities in both of the flow paths 11 and 13 can be equalized, and a reduction in the performance of the compressor can be prevented.

(Fourth Embodiment)

Next, a fourth embodiment is described with reference to FIGS. 15 to 18.

The fourth embodiment is characterized in that, in addition to the third embodiment, the hub side of the rear edge 7*b* of the splitter blade 7 is disposed so as to be displaced toward the positive-pressure surface Sa of the rear full blade 5R from the position equidistant from the front and rear full blades 5F and 5R in the circumferential direction.

Figure 15:
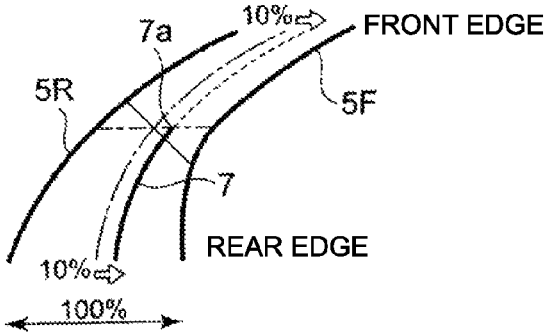
FIG. 15 is an explanatory view showing the relationship between a full blade and a splitter blade of a fourth embodiment and showing the relationship of a shroud-side circumferential position.
Figure 16:
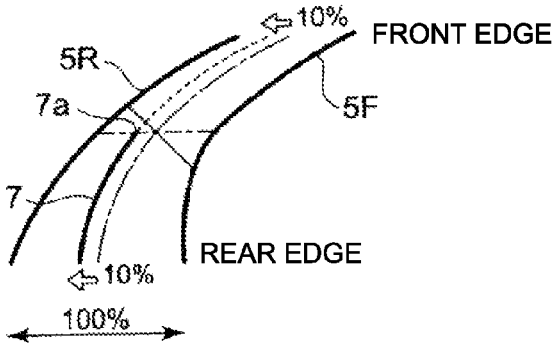
FIG. 16 is an explanatory view showing the relationship between the full blade and the splitter blade of the fourth embodiment and showing the relationship of a hub-side circumferential position.
Figure 17:
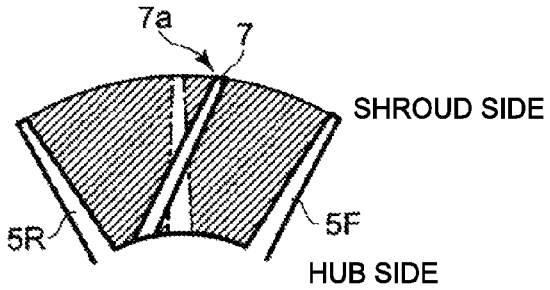
FIG. 17 is a front view showing a front edge shape of the splitter blade of the fourth embodiment.
Figure 18:
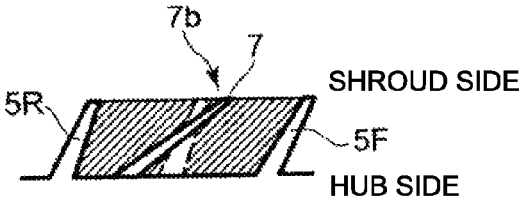
FIG. 18 is a front view showing a rear edge shape of the splitter blade of the fourth embodiment.

As shown in FIG. 15, the portion from the front edge 7*a* to the rear edge 7*b* on the shroud side is displaced toward the negative-pressure surface Sb of the front full blade 5F by 10% and, as shown in FIG. 16, the portion from the front edge 7*a* to the rear edge 7*b* on the hub side is also displaced toward the positive-pressure surface Sa of the rear full blade 5R by 10%.

With the above configuration, as explained in the third embodiment, the shroud side and the hub side are displaced in mutually opposite directions by the same amount in the portion of the front edge 7*a* of the splitter blade 7, and hence the nonuniformity in throat width between the flow paths 11 and 13 obtained by splitting by the splitter blade 7 is corrected and the flow rate distribution in the portion of the front edge is made uniform.

Further, in the fourth embodiment, the shroud side and the hub side are displaced in mutually opposite directions by the same amount also in the portion of the rear edge 7*b* of the splitter blade 7, and hence the uniformity in the flow rate distribution between the flow paths 11 and 13 obtained by splitting by the splitter blade 7 is further effectively achieved.

In addition, although the portion from the front edge 7*a* to the rear edge 7*b* of the splitter blade 7 is displaced toward the negative-pressure surface Sb of the front full blade 5F only on the shroud side in the third embodiment, the portion from the front edge 7*a* to the rear edge 7*b* is displaced toward the positive-pressure surface Sa of the rear full blade 5R also on the hub side in the fourth embodiment, and hence a deviation is less likely to occur in the front-rear distribution from the front edge to the rear edge of each of the flow paths 11 and 13 obtained by splitting by the splitter blade 7, the nonuniformity in flow velocity from the front edge to the rear edge is further less likely to occur, the flow velocity in each of the flow paths 11 and 13 obtained by splitting is not increased or decreased so that the flow velocity can be more equalized than in the third embodiment, and a reduction in the performance of the compressor can be prevented.

(Fifth Embodiment)

Next, a fifth embodiment is described with reference to FIGS. 19 and 20.

In the fifth embodiment, an inclination angle (angle of attack) opposing the flow of the fluid of the shroud side of the front edge 7*a* of the splitter blade 7 in the fourth embodiment is increased to be larger than the inclination angle of the front full blade 5F or the rear full blade 5R corresponding to the front edge 7*a* of the splitter blade 7, and is thereby set in a direction matching the direction of flow of the blade-end leakage vortex.

Figure 19:
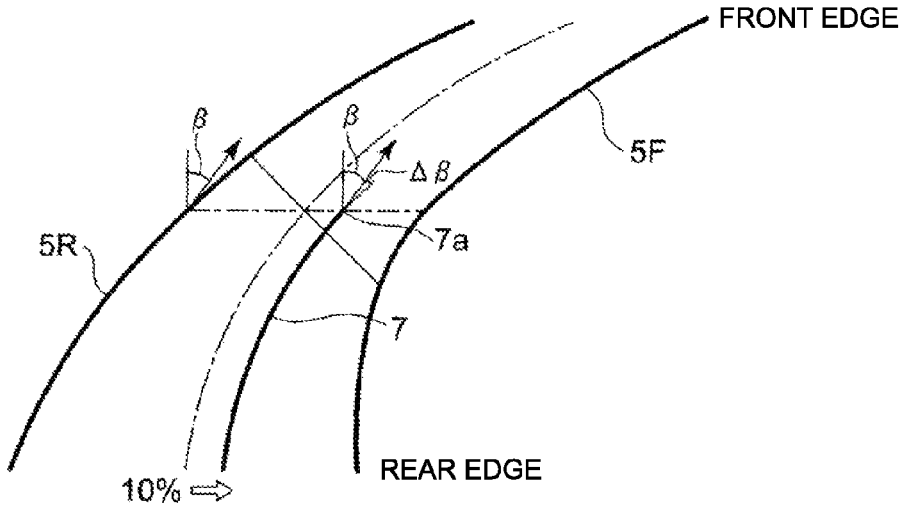
FIG. 19 is an explanatory view showing the relationship between a full blade and a splitter blade of a fifth embodiment and showing the relationship of a shroud-side circumferential position.
Figure 20:
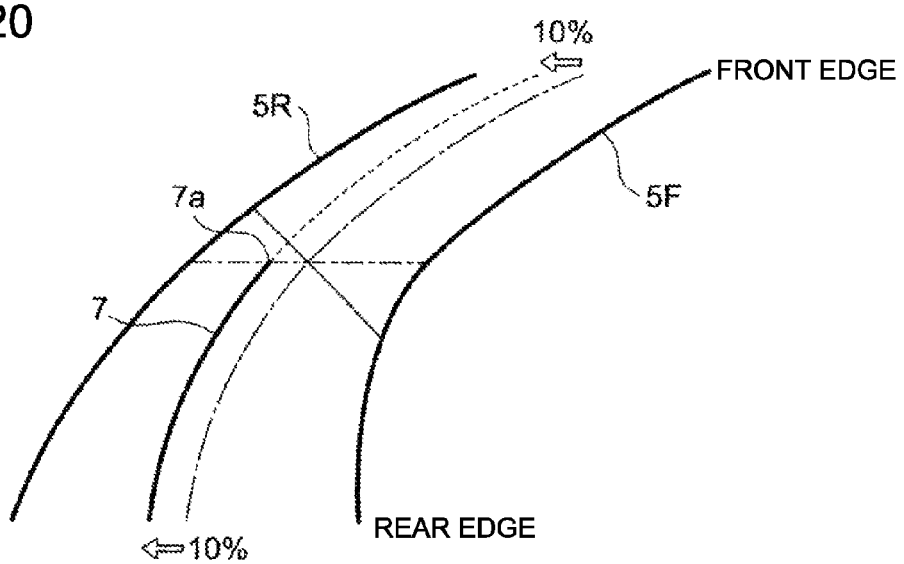
FIG. 20 is an explanatory view showing the relationship between the full blade and the splitter blade of the fifth embodiment and showing the relationship of a hub-side circumferential position.

As shown in FIG. 19, the fifth embodiment is applied only to the setting of the inclination angle of the shroud side of the front edge 7*a* of the splitter blade 7. With regard to the hub side, the angle is set to an angle similar to the corresponding inclination angle of the front or rear full blade 5F or 5R.

As shown in FIG. 19, the angle of attack of the shroud side of the front edge 7*a* of the splitter blade 7 is set to be larger than the inclination angle $\beta$ of the corresponding rear full blade 5R by $\Delta\beta$, and can be thereby set to the angle of attack matching the blade-end leakage flow W.

That is, the angle of attack of the front edge 7*a* of the splitter blade 7 is locally changed only in the vicinity of the tip of the splitter blade 7 to be caused to match the flow of the fluid, and hence high efficiency and the effect of improving characteristics are obtained more easily and effectively than in a case where the angle of attack is set to an angle equal to the inclination angle β at a position at the same blade height on the shroud side of the front or rear full blade 5F or 5R.

INDUSTRIAL APPLICABILITY

According to the present invention, in the impeller for the centrifugal compressor having the full blades provided adjacent to each other from the entrance portion to the exit portion of the fluid and the splitter blade provided between the full blades from some midpoint in the flow path to the exit portion, the interference of the front edge of the splitter blade with the blade-end leakage vortex from the tip portion of the front edge of the full blade is averted in the wide operation range and a high pressure ratio and high efficiency can be thereby achieved so that the present invention is suitably used in the impeller for the centrifugal compressor.

The invention claimed is:

1. An impeller for a centrifugal compressor, comprising:

a plurality of full blades, each full blade extending from an entrance portion to an exit portion of a fluid path on a hub surface;

a splitter blade provided from a midpoint in the flow path, formed between the full blades provided adjacent to each other, to the exit portion, the splitter blade having a front edge and a rear edge in a flow direction of the fluid, the front edge being positioned on an upstream side than the rear edge in the flow direction of the fluid, the splitter blade having a hub side and a shroud side in a direction of height of the splitter blade from a hub surface;

the shroud side of the front edge of the splitter blade being displaced toward a negative-pressure surface of the full blade from a position equidistant from the adjacent full blades in a circumferential direction of the impeller such that a blade-end leakage vortex generated during a high flow rate, which occurs from a blade-end clearance formed between a tip of the full blade and a shroud toward the front edge of the splitter blade, gets over the front edge of the splitter blade or such that the shroud side of the front edge of the splitter blade matches a direction of the blade-end leakage vortex, and the hub side of the rear edge of the splitter blade being displaced toward a positive-pressure surface of the full blade from the position equidistant from the full blades in the circumferential direction.

2. The impeller for a centrifugal compressor according to claim 1, wherein the hub side of the front edge of the splitter blade is displaced toward a positive-pressure surface of the full blade from the position equidistant from the full blades in the circumferential direction.

3. The impeller for a centrifugal compressor according to claim 2, wherein the shroud side of the rear edge of the splitter blade is displaced toward the negative-pressure surface of the full blade from the position equidistant from the full blades in the circumferential direction.

4. The impeller for a centrifugal compressor according to claim 1, wherein an inclination angle of the front edge of the splitter blade opposing the flow direction of the fluid is increased to be larger than an inclination angle of the full blade at a height identical to that of the front edge of the splitter blade.

5. An impeller for a centrifugal compressor, comprising:

a plurality of full blades, each full blade extending from an entrance portion to an exit portion of a fluid path on a hub surface;

a splitter blade provided from a midpoint in the flow path, formed between the full blades provided adjacent to each other, towards the exit portion, the splitter blade having a front edge and a rear edge in a flow direction of the fluid, the splitter blade having a hub side and a tip side in a direction of height of the splitter blade from a hub surface;

the tip side of the front edge of the splitter blade being displaced toward a negative-pressure surface of the full blade from a position equidistant from the adjacent full blades in a circumferential direction of the impeller;

the hub side of the front edge of the splitter blade being placed at the position equidistant from the adjacent full blades or displaced toward a positive-pressure surface of the full blade from a position equidistant from the adjacent full blades in the circumferential direction; and the hub side of the rear edge of the splitter blade being displaced toward the positive-pressure surface of the full blade from the position equidistant from the full blades in the circumferential direction.

* * * * *